US011806826B2

(12) United States Patent
Berglund et al.

(10) Patent No.: US 11,806,826 B2
(45) Date of Patent: Nov. 7, 2023

(54) AUTOMATIC BLADE HOLDER

(71) Applicant: PROSHARP INC.

(72) Inventors: Linus Berglund, Sundsvall (SE); Magnus Eriksson, Njurunda (SE)

(73) Assignee: PROSHARP INC., Worcester, MA (US)

( * ) Notice: Subject to any disclaimer, the term of this patent is extended or adjusted under 35 U.S.C. 154(b) by 522 days.

(21) Appl. No.: 16/988,610

(22) Filed: Aug. 8, 2020

(65) Prior Publication Data

US 2021/0069853 A1 Mar. 11, 2021

Related U.S. Application Data

(63) Continuation-in-part of application No. 16/854,433, filed on Apr. 21, 2020.

(60) Provisional application No. 62/898,989, filed on Sep. 11, 2019.

(51) Int. Cl.

| | |
|---|---|
| ***B24B 21/00*** | (2006.01) |
| ***B24B 3/36*** | (2006.01) |
| ***B24B 3/00*** | (2006.01) |
| ***B24D 15/06*** | (2006.01) |
| ***B24B 9/04*** | (2006.01) |

(52) U.S. Cl.

CPC ..... *B24B 21/006* (2013.01); *B24B 3/003* (2013.01); *B24B 3/36* (2013.01); *B24B 9/04* (2013.01); *B24B 21/002* (2013.01); *B24D 15/066* (2013.01)

(58) Field of Classification Search

CPC ..... B24B 3/003; B24B 9/04; B24B 5/162; B24B 17/02; B24B 17/021; B24B 17/023; B24D 15/066

USPC ..... 451/45

See application file for complete search history.

(56) References Cited

U.S. PATENT DOCUMENTS

| | | | |
|---|---|---|---|
| 3,956,857 | A | 5/1976 | Weisman |
| 3,988,865 | A | 11/1976 | Weisman |
| 4,993,725 | A | 2/1991 | Barnes |
| 5,103,597 | A | 4/1992 | Courchesne |
| 5,127,194 | A | 7/1992 | Jobin |

(Continued)

FOREIGN PATENT DOCUMENTS

| | | | | |
|---|---|---|---|---|
| CA | 2217783 A1 * | 6/1999 | ..... | B24B 21/002 |
| DE | 112020003834 | 4/2022 | | |

(Continued)

OTHER PUBLICATIONS

English Translation of EP 0035939 B1 (Year: 2023).*

(Continued)

*Primary Examiner* — Don M Anderson
*Assistant Examiner* — Ian James Geiger

(57) ABSTRACT

The method is for profiling blades with a belt grinding profiling machine. The blades are mounted into a vise. A vertical position of the template is adjusted by rotating the rotatable knob. The motor is turned on to rotate the grinding belt over the grinding wheel. The guide wheel engages the underside profile of the template. The guide wheel of the template guides movement of the grinding wheel mounted on the common axle by moving the guide wheel along the underside profile of the template. The grinding belt grinds material off the underside of the blade until a portion of the underside profile of the template is copied to the underside of the blade.

18 Claims, 11 Drawing Sheets

(56) References Cited

U.S. PATENT DOCUMENTS

| | | | |
|---|---|---|---|
| 5,167,170 | A | 12/1992 | Croteau |
| 5,189,845 | A | 3/1993 | Courchesne |
| 5,195,277 | A | 3/1993 | Courchesne |
| 5,197,232 | A | 3/1993 | Ellestad |
| 5,239,785 | A | 8/1993 | Allen |
| 5,287,657 | A | 2/1994 | Tschida et al. |
| 5,345,688 | A | 9/1994 | Allen |
| D352,880 | S | 11/1994 | Anderson |
| 5,381,629 | A | 1/1995 | Salvail |
| 5,383,307 | A | 1/1995 | Anderson |
| 5,431,597 | A | 7/1995 | Anderson |
| 5,445,050 | A | 8/1995 | Owens |
| 5,492,037 | A | 2/1996 | Graham |
| 5,499,556 | A | 3/1996 | Exner et al. |
| 5,547,416 | A | 8/1996 | Timms |
| 5,564,973 | A | 10/1996 | Salvail |
| 5,569,064 | A | 10/1996 | Gleadall |
| 5,582,535 | A | 12/1996 | Friel |
| 5,591,069 | A | 1/1997 | Wurthman |
| 5,601,473 | A | 2/1997 | Strain et al. |
| 5,607,347 | A | 3/1997 | Schoen et al. |
| 5,704,829 | A | 1/1998 | Long |
| D390,084 | S | 2/1998 | McCabe |
| D392,536 | S | 3/1998 | Anderson |
| D394,196 | S | 5/1998 | Richardson |
| 5,791,974 | A | 8/1998 | Sakcriska |
| 5,879,229 | A | 3/1999 | Anderson |
| 5,897,428 | A | 4/1999 | Sakcriska |
| 5,916,018 | A | 6/1999 | Watt |
| 6,030,283 | A | 2/2000 | Anderson |
| 6,067,880 | A | 5/2000 | Arrigoni |
| 6,116,989 | A | 9/2000 | Balastik |
| 6,218,639 | B1 | 4/2001 | Bulle |
| 6,312,017 | B1 | 11/2001 | Hardwick et al. |
| 6,422,934 | B1 | 7/2002 | Blach et al. |
| 6,443,819 | B2 | 9/2002 | Sakcriska |
| 6,481,113 | B1 | 11/2002 | Brenner et al. |
| 6,579,163 | B1 | 6/2003 | Ross et al. |
| 6,594,914 | B1 | 7/2003 | Babcock |
| 6,726,543 | B1 | 4/2004 | Klosterman |
| 6,761,363 | B2 | 7/2004 | Fask et al. |
| 7,097,547 | B2 | 8/2006 | McCroary |
| D529,361 | S | 10/2006 | Brookman |
| 7,191,539 | B2 | 3/2007 | Zukerman |
| 7,220,161 | B2 | 5/2007 | Eriksson |
| 7,434,324 | B2 | 10/2008 | McKenna |
| 7,473,164 | B2 | 1/2009 | Sunnen |
| 7,547,022 | B2 | 6/2009 | Broadbent |
| D603,432 | S | 11/2009 | Wilson et al. |
| 7,748,130 | B2 | 7/2010 | McKenna |
| 7,918,035 | B1 | 4/2011 | Jarczewski |
| 7,934,978 | B2 | 5/2011 | Wilson et al. |
| 8,047,552 | B2 | 11/2011 | Julien |
| 8,277,284 | B2 | 10/2012 | Wilson et al. |
| 8,430,723 | B2 | 4/2013 | Moon |
| 8,574,030 | B2 | 11/2013 | Wilson et al. |
| 8,827,768 | B2 | 9/2014 | Allen |
| 8,851,961 | B2 | 10/2014 | Frommer et al. |
| 8,888,567 | B2 | 11/2014 | Allen et al. |
| 8,944,889 | B2 | 2/2015 | Frommer et al. |
| D725,453 | S | 3/2015 | Lodato et al. |
| 9,114,498 | B1 | 8/2015 | Layton et al. |
| 9,242,330 | B1 | 1/2016 | Layton, Jr. et al. |
| 9,259,637 | B2 | 2/2016 | Wilson et al. |
| 9,308,613 | B2 | 4/2016 | Eriksson |
| 9,339,911 | B2 | 5/2016 | Eriksson |
| 9,352,437 | B2 | 5/2016 | Layton et al. |
| 9,352,444 | B2 | 5/2016 | Layton et al. |
| 9,475,175 | B2 | 10/2016 | Layton, et al. |
| 9,480,903 | B2 | 11/2016 | Wilson et al. |
| 9,517,543 | B2 | 12/2016 | Proulx |
| 9,566,682 | B2 | 2/2017 | Layton, et al. |
| 9,573,236 | B2 | 2/2017 | Layton et al. |
| 9,651,466 | B2 | 5/2017 | Brown et al. |
| 9,669,508 | B2 | 6/2017 | Layton et al. |
| D793,830 | S | 8/2017 | Layton et al. |
| 9,895,786 | B2 | 2/2018 | Frommer et al. |
| 9,895,791 | B2 | 2/2018 | Bleier |
| 9,897,430 | B2 | 2/2018 | Layton et al. |
| 9,902,035 | B2 | 2/2018 | Layton, et al. |
| 10,065,282 | B2 | 9/2018 | Layton et al. |
| D845,793 | S | 4/2019 | Di Nardo et al. |
| 10,300,574 | B2 | 5/2019 | Layton et al. |
| 10,335,925 | B2 | 7/2019 | Layton et al. |
| 10,384,329 | B2 | 8/2019 | Downen |
| 10,406,647 | B2 | 9/2019 | Tatomir |
| 10,500,463 | B2 | 12/2019 | Stastny et al. |
| 10,533,834 | B2 | 1/2020 | Di Nardo et al. |
| 10,583,347 | B2 | 3/2020 | Proulx |
| 10,926,379 | B2 | 2/2021 | Bleier |
| 11,103,974 | B2 | 8/2021 | Chan et al. |
| 11,148,035 | B2 | 10/2021 | Shaffer |
| 2003/0148716 | A1 | 8/2003 | Lyons |
| 2004/0244538 | A1 | 12/2004 | Franzen et al. |
| 2005/0029755 | A1 | 2/2005 | Fask et al. |
| 2005/0130571 | A1 | 6/2005 | Sunnen |
| 2006/0065076 | A1 | 3/2006 | Friol |
| 2006/0183411 | A1 | 8/2006 | Moon |
| 2006/0223419 | A1 | 10/2006 | Moon |
| 2007/0068022 | A1 | 3/2007 | McKenna |
| 2009/0206562 | A1 | 8/2009 | Podolsky |
| 2009/0206563 | A1 | 8/2009 | Ferras |
| 2010/0201088 | A1 | 8/2010 | Newman et al. |
| 2011/0203416 | A1 | 8/2011 | Grodin |
| 2012/0104705 | A1 | 5/2012 | Swist |
| 2012/0108151 | A1 | 5/2012 | Swist |
| 2012/0227204 | A1 | 9/2012 | Maye |
| 2014/0090445 | A1 | 4/2014 | Norman |
| 2014/0225337 | A1 | 8/2014 | Olson |
| 2015/0140901 | A1 | 5/2015 | Eriksson |
| 2015/0140902 | A1 | 5/2015 | Eriksson |
| 2015/0367224 | A1 | 12/2015 | Schatz |
| 2016/0059107 | A1 | 3/2016 | Finley |
| 2016/0096252 | A1 | 4/2016 | Layton et al. |
| 2016/0250732 | A1 | 9/2016 | Layton et al. |
| 2017/0320184 | A1* | 11/2017 | Tatomir ..... B24B 3/003 |
| 2018/0126250 | A1 | 5/2018 | Proulx |
| 2019/0038957 | A1 | 2/2019 | Histed et al. |
| 2019/0176292 | A1 | 6/2019 | Chan et al. |
| 2020/0206878 | A1 | 7/2020 | Downen |
| 2020/0309499 | A1 | 10/2020 | Hauer |
| 2020/0316745 | A1 | 10/2020 | Maxwell |
| 2020/0338691 | A1 | 10/2020 | Downen |
| 2021/0069850 | A1 | 3/2021 | Eriksson et al. |
| 2021/0162561 | A1 | 6/2021 | Chan et al. |
| 2021/0308835 | A1 | 10/2021 | Bleier |
| 2021/0346783 | A1 | 11/2021 | Stuhr et al. |
| 2022/0040812 | A1 | 2/2022 | Eriksson et al. |
| 2022/0212308 | A1 | 7/2022 | Berglund et al. |

FOREIGN PATENT DOCUMENTS

| | | | |
|---|---|---|---|
| DE | 112020003835 | | 4/2022 |
| EP | 0035939 | B1 * | 5/1983 |
| EP | 0128430 | | 8/1988 |
| EP | 1584410 | A2 | 10/2005 |
| EP | 3071367 | | 11/2022 |
| GB | 608207 | | 9/1948 |
| SE | 443315 | | 2/1986 |
| SE | 527015 | C2 | 12/2005 |
| SE | 545052 | C2 | 3/2023 |
| SE | 545053 | C2 | 3/2023 |
| WO | 2016183663 | A1 | 11/2016 |
| WO | 2021/050349 | | 3/2021 |
| WO | 2021/050351 | | 3/2021 |

OTHER PUBLICATIONS

16988610_2023-06-14_CA_2217783_A1_H.pdf (Year: 2023).*

International Search Report and Written Opinion dated Nov. 17, 2020 in connection with International Patent Application No. PCT/US2020/049172, 5 pages.

(56) References Cited

OTHER PUBLICATIONS

International Search Report and Written Opinion dated Nov. 19, 2020 in connection with International Patent Application No. PCT/US2020/049166, 5 pages.
Non-Final Office Action dated Mar. 16, 2023 in connection with U.S. Appl. No. 16/854,433, 25 pages.
Restriction requirement dated Apr. 11, 2023 in connection with U.S. Appl. No. 17/508,199, 8 pages.
International Preliminary Report on Patentability dated Mar. 15, 2022 in connection with International Patent Application No. PCT/US2020/049166,4 pages.
International Preliminary Report on Patentability dated Mar. 15, 2022 in connection with International Patent Application No. PCT/US2020/049172, 4 pages.
Notice of Allowance (Final Notice) issued by the Swedish Patent Office dated Oct. 14, 2022 in connection with Swedish Patent Application No. 2250328-8, 3 pages.
Notice of Allowance (Final Notice) issued by the Swedish Patent Office dated Oct. 14, 2022 in connection with Swedish Patent Application No. 2250329-6, 3 pages.
Notice of Allowance issued by the European Patent Office dated May 30, 2022 in connection with European Patent Application No. 14864954.4, 7 pages.
Swedish Search Report issued by the Swedish Patent Office dated Oct. 14, 2022 in connection with Swedish Patent Application No. 2250328-8, 3 pages.
Swedish Search Report issued by the Swedish Patent Office dated Oct. 14, 2022 in connection with Swedish Patent Application No. 2250329-6, 2 pages.
Excerpt from Marinescu et al., Tribology and Fundamentals of Abrasive Machining Processes, 2nd edition, 2013, Chapter 9.9.4, consulted on Jun. 12, 2023 https://www.sciencedirect.com/topics/engineering/abrasive-belts.

* cited by examiner

AUTOMATIC BLADE HOLDER

PRIOR APPLICATION

This is a continuation-in-part patent application that claims priority from U.S. utility patent application Ser. No. 16/854,433, filed 21 Apr. 2020 that claims priority from U.S. provisional patent application No. 62/898,989, filed 11 Sep. 2019.

TECHNICAL FIELD

The invention relates to an automatic blade holder that automatically senses the number of blades held in the blade holder and horizontally shifts the blades upon completion to make sure the next time the blade holder is used, a non-worn portion of the grinding belt aligned on top of the next batch of blades to be sharpened.

BACKGROUND AND SUMMARY OF THE INVENTION

Sharpening apparatuses for grinding or sharpening blades such as skate blades have been available for decades. However, the prior art sharpening apparatuses are often manual and require extensive skills and experience of the person doing the sharpening. This results in varying sharpening results and makes it more difficult for users of skate blades to obtain properly sharpened skate blades. There is a need for an effective sharpening method and apparatus that is easy to use while providing consistent and high-quality sharpening of skate blades. There is a need for a better and a more reliable blade holder used for sharpening blades.

The automatic blade holder of the present invention provides a solution to the above-outlined problems. More particularly, the blade holder of the present invention has a movable plate and a fixture. A rotatable bolt is in operative engagement with a block attached to the plate. A motor is in operative engagement with the bolt. The motor rotates the bolt to move the plate towards (or away from) the fixture to grip a first set of blades until a torque threshold value is reached. The processor determines a number of blades included in the set of blades based on the number of rotations of the bolt when the torque threshold value is reached. A first grinding portion of a rotating abrasive belt is applied against the first set of blades, wherein the first set of blades has a total width W1, to sharpen the set of blades. A vise is slid sideways a distance W1 until a second grinding portion is aligned on top of the second set of blades.

The method further comprises the step of the motor automatically reducing a gripping force for a second set of blades wherein the second set of blades includes fewer blades than the first set of blades.

The method further comprises the step of sliding a slide, attached to the vise, along a rail to shift the vise relative to the belt.

The method further comprises the step of providing a linear actuator that has a rod in rotational engagement with a bolt secured to a piece in operational engagement with the slide.

The method further comprises the step of simultaneously sharpening the blades contained in the first set of blades.

The method further comprises the step of rotating the rod to shift the vise relative to the belt (186).

The method further comprises the step of inserting a motor shaft into the bolt.

The method further comprises the step of providing the block with an opening defined therein to threadedly engage the bolt.

The method further comprises the step of determining a gripping gap between the plate and the fixture by counting a number of rotations of the shaft.

The method further comprises the step of providing the shaft with an elongate protrusion and inserting the protrusion into a groove at an end of the bolt.

The method of the present invention for profiling blades with a belt grinding profiling machine. A belt grinding profiling machine is provided that has an electric for driving a grinding wheel with a grinding belt in operative engagement with the motor and grinding wheel. A guide wheel and the grinding wheel are mounted on a common axle. The machine has a tiltable vise, that is shiftable in a horizontal direction along a rail attached to the machine, and a rotatable knob in operative engagement with a template that has an underside profile. The blade has an underside. The blades are mounted into the vise. A vertical position of the template is adjusted by rotating the rotatable knob. The motor is turned on to rotate the grinding belt over the grinding wheel. The guide wheel engages the underside profile of the template. A movement of the guide wheel along the underside profile of the template guiding a movement of the grinding wheel mounted on the common axle; and the grinding belt grinding material off the underside of the blade until a portion of the underside profile of the template is copied to the underside of the blade.

The method further comprises the step of tilting the vise from a horizontal closed position to an upright tilted position prior to mounting the blades inside the vise.

Additionally, the method further comprises the step of providing a handle, turning the handle to tighten the blade mounted in the vise.

The method further comprises the step of positioning the underside profile of the template relative to the guide roll.

Furthermore, the method further comprises the step of positioning the grinding wheel relative to the underside of the blade.

The method further comprises the step of stopping the grinding of the blade when the guide roll is rollable along the underside profile of the template.

Additionally, the method further comprises the step of mounting the template to a template holder by tightening locking knobs extending through the template.

The method further comprises the step of moving the vise back and forth on the rail, prior to turning on the motor, while adjusting the position of the grinding wheel relative to the underside of the blade.

Finally, the method further comprises the step of providing the underside profile with two different profiles wherein a first profile at a rear portion of the template is equivalent to a section of a periphery of a first circle having a first radius and a front portion of the template is equivalent to a second of a periphery of a second circle having a second radius.

DETAILED DESCRIPTION

Figure 1:
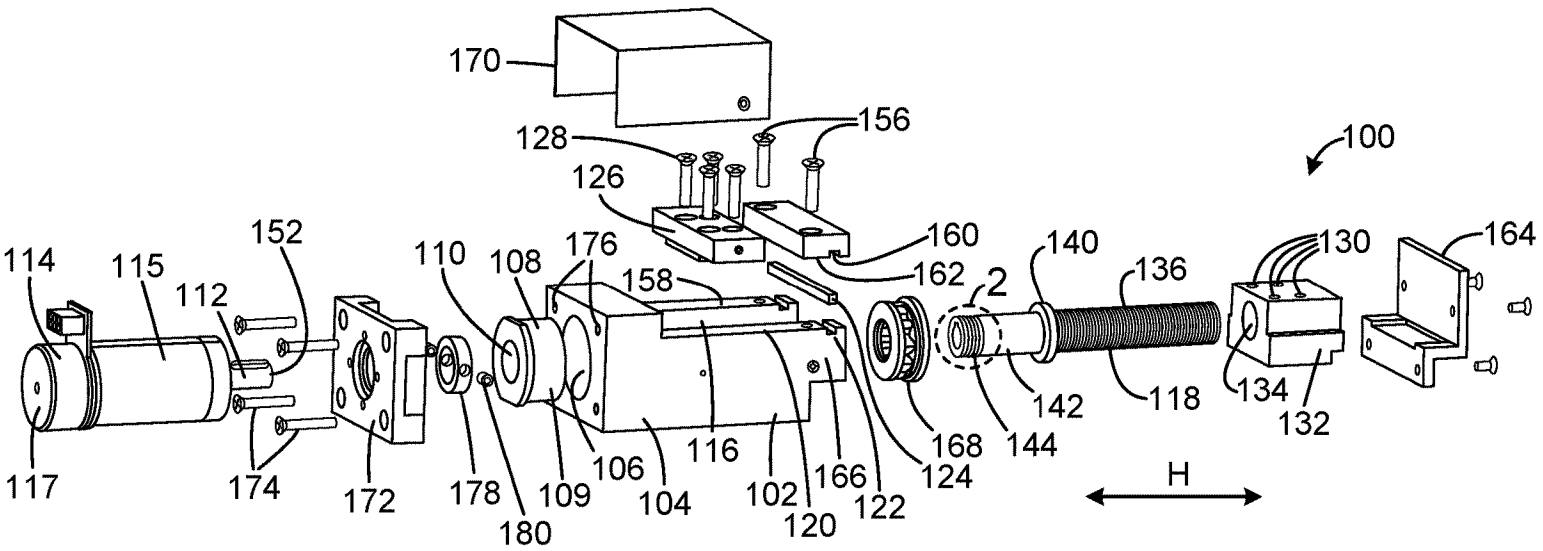
FIG. 1 is an exploded side view of a portion of the blade holder of the present invention.
Figure 2:
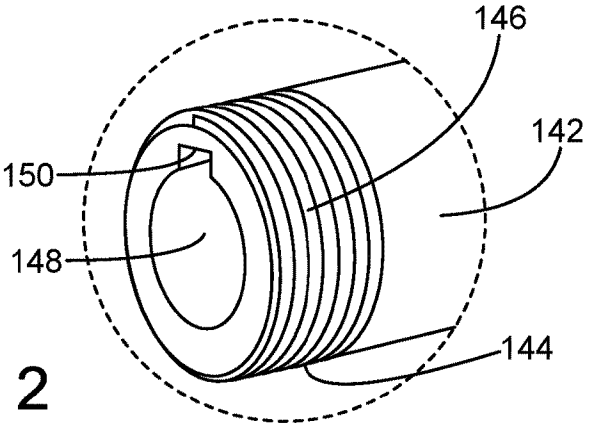
FIG. 2 is a detailed view of the end of the smooth section of the present invention.

With reference to FIG. 1, the blade holder 100 has a sturdy vise 102 that acts as a frame for all other components and is designed to withstand all the forces that is applied thereon. The blade holder 100 is very compact. An important feature of the blade holder is that it can automatically determine how many blades are to be sharpened and how hard the blades should be clamped or held together. In other words, the blade holder 100 automatically adjusts the gripping force or torque value depending on how many blades are to be simultaneously sharpened. It can also automatically shift the entire holding mechanism so that a new non-worn portion of the sharpening belt is aligned with the next batch of blades that are to be sharpened by the belt.

The vise 102 has a hollow space 116 defined therein to receive a rotatable threaded bolt 118, as explained in detail below. The vise 102 has, at one end 104, a round opening 106 defined therein and therethrough to receive a round inset 108. The inset 108 has a round opening 110 defined therein to receive a rotatable motor shaft 112 extending from a gearbox 115 of an electric motor 114. The inset 108 prevents horizontal movement of the bearing 168 and has an outside thread 109 that is screwed into the round opening 106. The motor 114 has an encoder 117 that measures and monitors the number of rotations of the shaft 112. An upper side 120 of the vise 102 has a groove 122 defined therein to receive a wedge 124. A plate 126, having bolts 128, rests on the upper side 120 of vise 102. The bolts 128 are screwed into threaded openings 130 defined in a shiftable or movable block 132 to hold the plate 126 to the block 132. The block 130 has a round opening 134 defined therein to receive a threaded portion 136 of the bolt 118. The plate 126 may be integral with the block 132.

As explained below, by keeping track of the number of rotations of the shaft 112, it is possible to determine how much the plate 126 has been shifted horizontally relative to the fixture 154 and how big the gripping gap 119 (best shown in FIG. 3) is between an engagement surface 121 of the plate 126 and an opposite engagement surface 123 the fixture 154. It is also possible to determine the size of the gap 119 by sensing the position of the plate 126 with a position sensor without measuring the number of rotations of the shaft 112.

The bolt 118 has a flange 140 that has a diameter greater than a diameter of the threaded portion 136. One function of the flange 140 is to prevent horizontal movement of the bolt 118 during operation of the blade holder 100. The flange 140 separates the threaded portion 136 from a smooth section 142. At an end 144 of the smooth section 142, there is a threaded section 146 that has an opening 148 defined therein. The opening 148 has a cut-out 150 defined therein to receive an elongate protrusion 152 of the shaft 112 of the motor 114 to prevent the shaft 112 from rotating relative to the bolt 118 so that when the shaft 112 is rotated the bolt 118 also rotates.

The upper surface 120 also supports a fixture 154 that has bolts 156 being fixed but removably secured to the vise 102 by screwing the bolts 156 into threaded openings 158 on the upper surface 120. The fixture 154 has a groove 160 at a bottom surface 162 to receive an upper portion of the wedge 124. The block 130, with the plate 126 attached thereto, is movable or shiftable in the horizontal direction (H), by turning the bolt 118, so that blades can be captured and held between the plate 126 and the fixture 154, as described in detail below.

A covering plate 164 is attached to a second end 166 of the vise 102 to provide dust and particle protection to the vice 102. A bearing 168 is rotatably engaging the smooth section 142 of the bolt 118 that allows the bolt 118 to turn or rotate with minimum friction as rotatable or torque forces are applied to the bolt 118. The inset 108 has the function of preventing the bearing 168 from moving in the horizontal direction (H) so that the bearing 168 is captured between the inset 108 and the flange 140.

A U-shaped cover plate 170 is placed on top of the vise 102 to prevent or reduce dust and particles from moving into and through the vise 102.

A motor mounting plate 172 is mounted by bolts 174 to the end 104 of vise 102 by screwing the bolts 174 into openings 176 at the end 104. A lock-nut 178 is provided to prevent the bolt 118 from moving in the horizontal direction (H). The lock-nut 178 has a screw 180 that can be screwed against the bolt 118 to hold it in place. The motor mounting plate 172 attaches the motor 114 and gearbox 115 to the vise 102.

Figure 4:
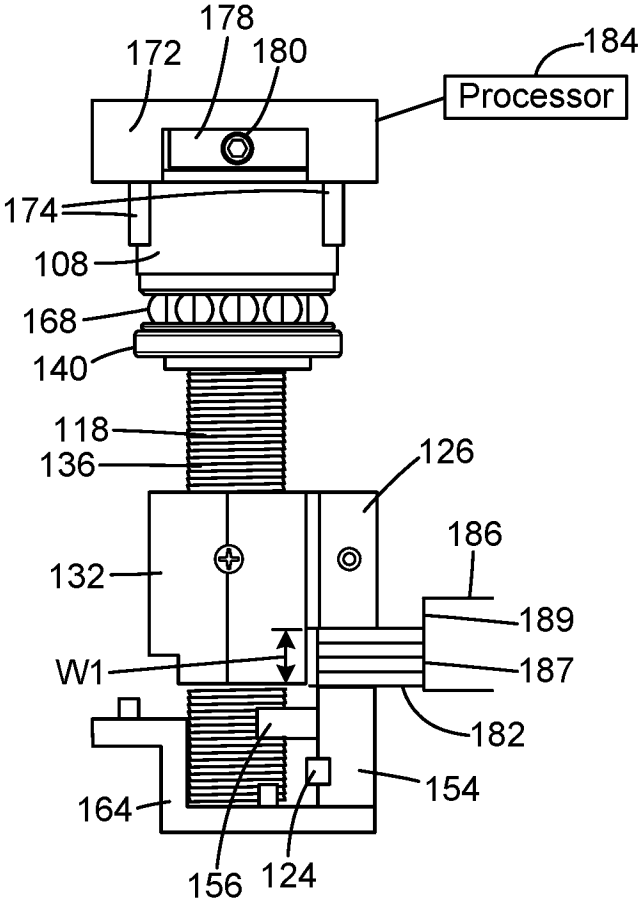
FIG. 4 is an elevation side of the portion of the blade holder of the present invention holding a plurality of blades.
Figure 3:
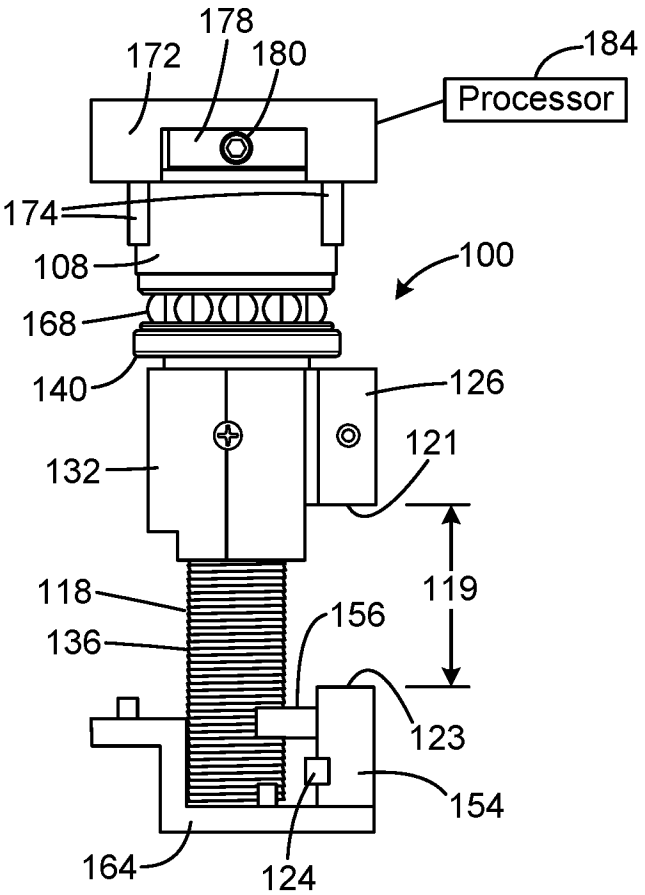
FIG. 3 is an elevational side view of a portion of the blade holder in an open position.

FIG. 3 shows the blade holder 100 in an open assembled position (with the vise 102 removed for clarity) while FIG. 4 shows the blade holder 100 in a closed position with a plurality of blades 182 held firmly between plate 126 and fixture 154. Each blade 182, such as a skate blade, is typically about 3 millimeters wide but other widths can also be used. The motor 114 rotates the shaft 112, via gearbox 115, a certain number of revolutions, which in turn, rotates the screw 118.

The blade holder 100 is connected to a computer processor 184 that runs on software. As mentioned earlier, the processor 184 keeps, among other things, track of the number of revolutions the shaft 112 has been rotated. The processor 184 also monitors the torque force required to rotate the shaft 112. While the blades 182 are loosely held between the plate 126 and the fixture 154 very little torque force of the motor 114 is required to turn the shaft 112 that is in operative engagement with the bolt 118 as the protrusion 152 engages the groove 150. The threaded portion 136 is in threaded operative engagement with the threaded opening 134 of block 132 so when the threaded portion 136 is rotated, the block 132 moves horizontally away or towards the flange 140. When a gripping side or engagement surface 121 of the plate 126 encounters and abuts the blades 182 to move the blades together the torque required to horizontally move the blades 182 increases. When all the blades 182 are in contact with one another, the torque required to further rotate the shaft 112 increases substantially to a threshold value. The processor 184 monitors the torque that is generated by the motor 114. When the torque required reaches the threshold value, the processor 184 determines the number of blades 182 that are held between the plate 126 and fixture 152 because the processor 184 has received input regarding the thickness of each blade 182 and the initial distance between the plate 126 and the fixture 154. The threshold value could be any suitable value such as 3-7 Nm. After the processor 182 has determined the number of blades 182 held by the blade holder 100, the processor 184 determine the final torque value that must be reached to firmly hold the plurality of blades 182 during the sharpening procedure of the blades. The final torque value could, for example, be 5-11 Nm but higher and lower values can also be used. The higher the number of blades held the higher the final torque value should be. By knowing the number of blades 182, the processor 184 also calculates the total width W of the set of blades 182. This width W1 wears on a first grinding section 187 of the rotating abrasive belt 186 as the rotating abrasive belt 186 grinds against the set of blades 182 to sharpen the blades. The belt 186 may have any suitable width such as 40 mm. After the sharpening of the blades 182 is complete, the processor 184, preferably, shifts the vise 102 horizontally, to a distance that is equivalent to the width W1, so that a non-worn second grinding portion 189 of the sharpening belt 186 is positioned over the next set of blades 191 that are to be sharpened, as explained below. The fact that the vise 102 can be shifted prolongs the useful life of the abrasive belt 186 and it also ensures that the belt sharpens evenly i.e. it prevents the worn section 187 to engage a portion of the blades while a non-worn section 189 engages another portion of the set of blades. Instead, the vise 102 is shifted until the non-worn portion 189 is aligned on top of the new set of blades 191 that has a width W2. Preferably, the vise 102 is only shifted between the sharpening sessions of each new set of blades. It may also be possible for the processor 184 to require a shifting of the vise 102 after a certain time period (such as 500 seconds) or after a certain number of revolutions of the motor that drives the belt 186. When the full width of the belt 186 has been used it is time to replace the belt 186 with a new non-worn belt.

Figure 5:
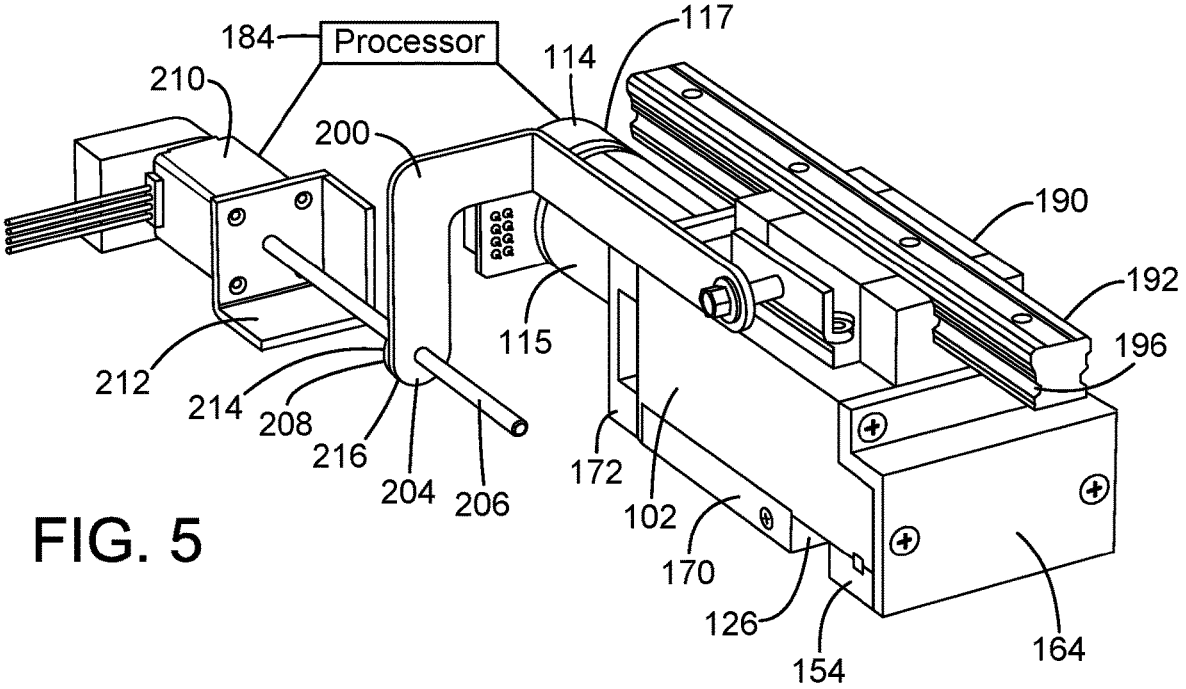
FIG. 5 is a perspective view of the blade holder of the present invention showing a shifting mechanism.
Figure 6:
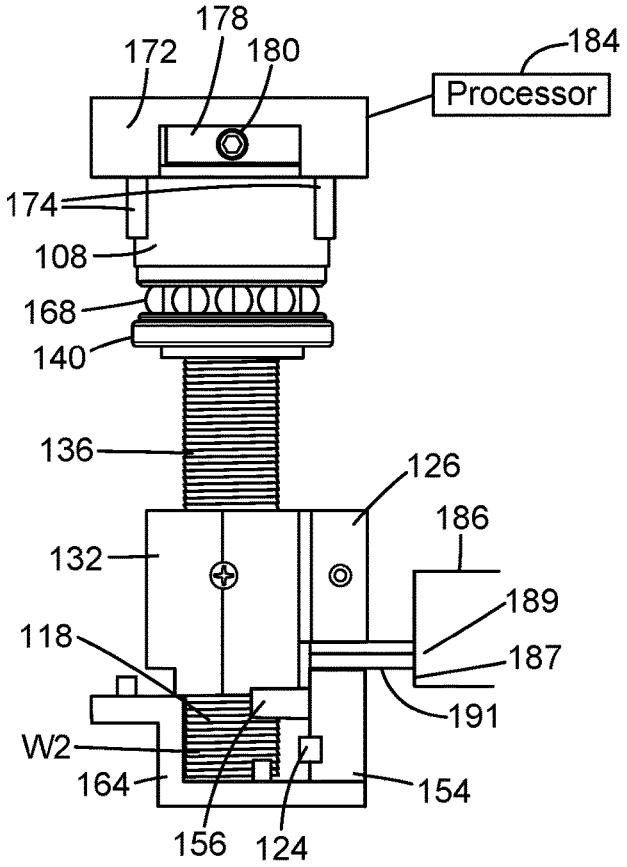
FIG. 6 is substantially similar to the view of FIG. 4 but shows the grinding belt shifted to the side to align a non-worn belt portion with the new set of blades to be sharpened.

FIG. 5 is a perspective view that shows the shifting mechanism on an underside of the blade holder 100. The vise 102 rests on and is attached to a slide 190 that is slidable on a linear rail 192 wherein elongate protrusions 194 of the slide 190 follow the elongate grooves 196 on the rail 192. A mounting bracket 198 is attached or secured to the slide 190. The bracket 198 is attached to angled metal piece 200 by a bolt 202. A bottom end 204 of the piece 200 is fastened to an elongate threaded piston or rod 206 by a threaded nut 208. By rotating the nut 208 the nut 208 travels along the rod 206. The rod 206 is in operative rotatable engagement with a linear actuator or electric motor 210 via a mounting bracket 212. The actuator 210 is also connected to the processor 184. The rod 206 has outside threaded portion 214 that is in operative engagement with inside thread 216 of the nut 208 so that when the rod 206 rotates the piece 200 moves away or towards the actuator 210 as the threaded rod 206 rotates inside the nut 208 that is secured to the bottom end 204. The software is programmed to know how many rotations of the rod 206 are equivalent to the width W of the blades 182 to be sharpened. Because the piece 200 is connected to the vise 102 and slide 190, horizontal movement of the piece 200 also moves the slide 190 relative to the rail 192. As mentioned above, the grinding or sharpening of a first set of blades 182 wears a portion W1 of the belt 186. Upon completion of the grinding of the first set of blades, it is possible to shift the slide 190 horizontally sideways so that a new non-worn portion 189 is aligned with a new set of blades 191, placed and firmly held between the plate 126 and the fixture 154, that are to be sharpened. In this way, it is not necessary to replace the belt 186 each time a new set of blades is to be sharpened because a non-worn portion 189 of the belt 186. In this way, the belt 186 can be used to sharpen many sets of blades until the entire width of the belt 186 is worn from grinding.

Figure 7:
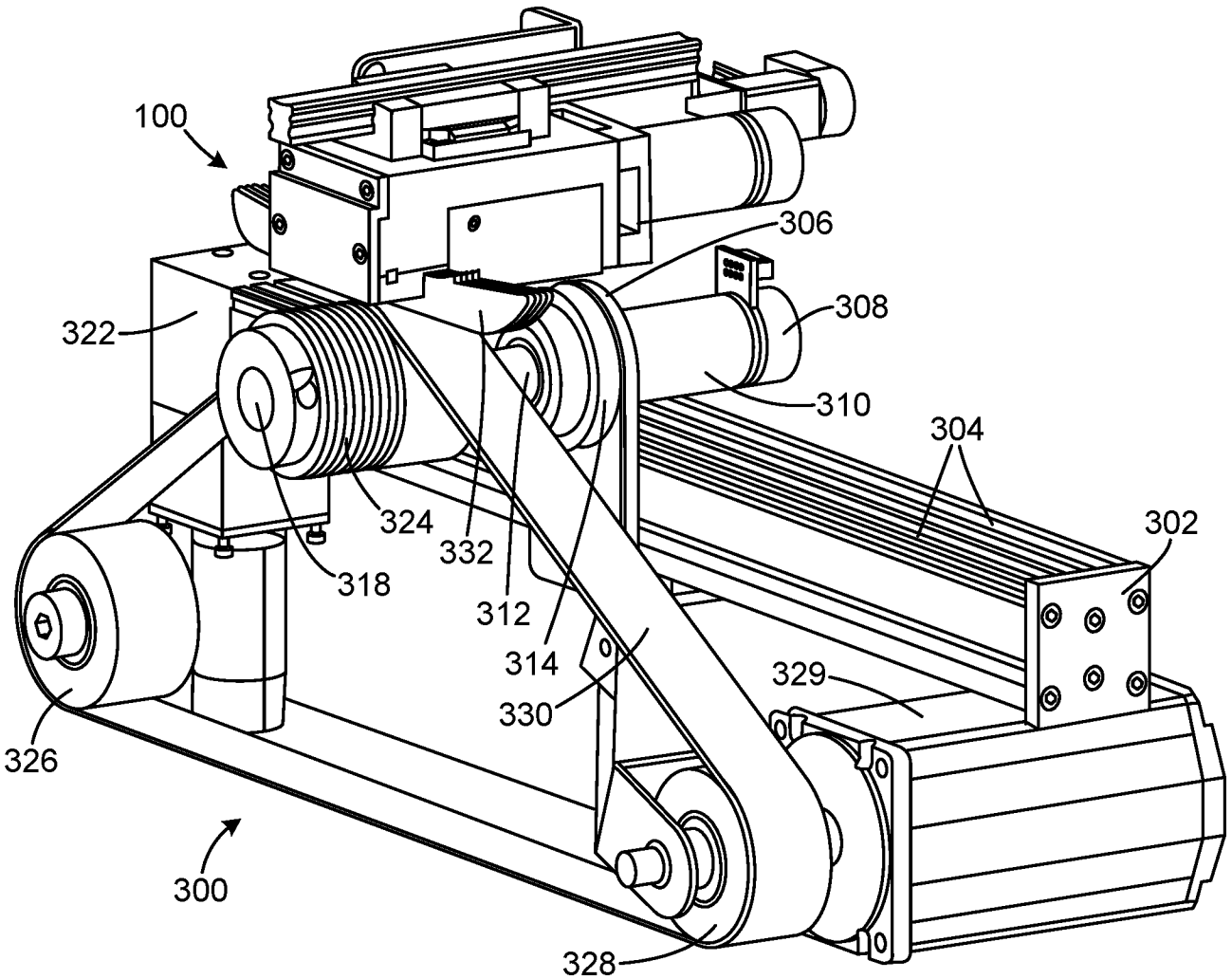
FIG. 7 is a perspective view of the blade holder of the present invention including an abrasive belt assembly.
Figure 8:
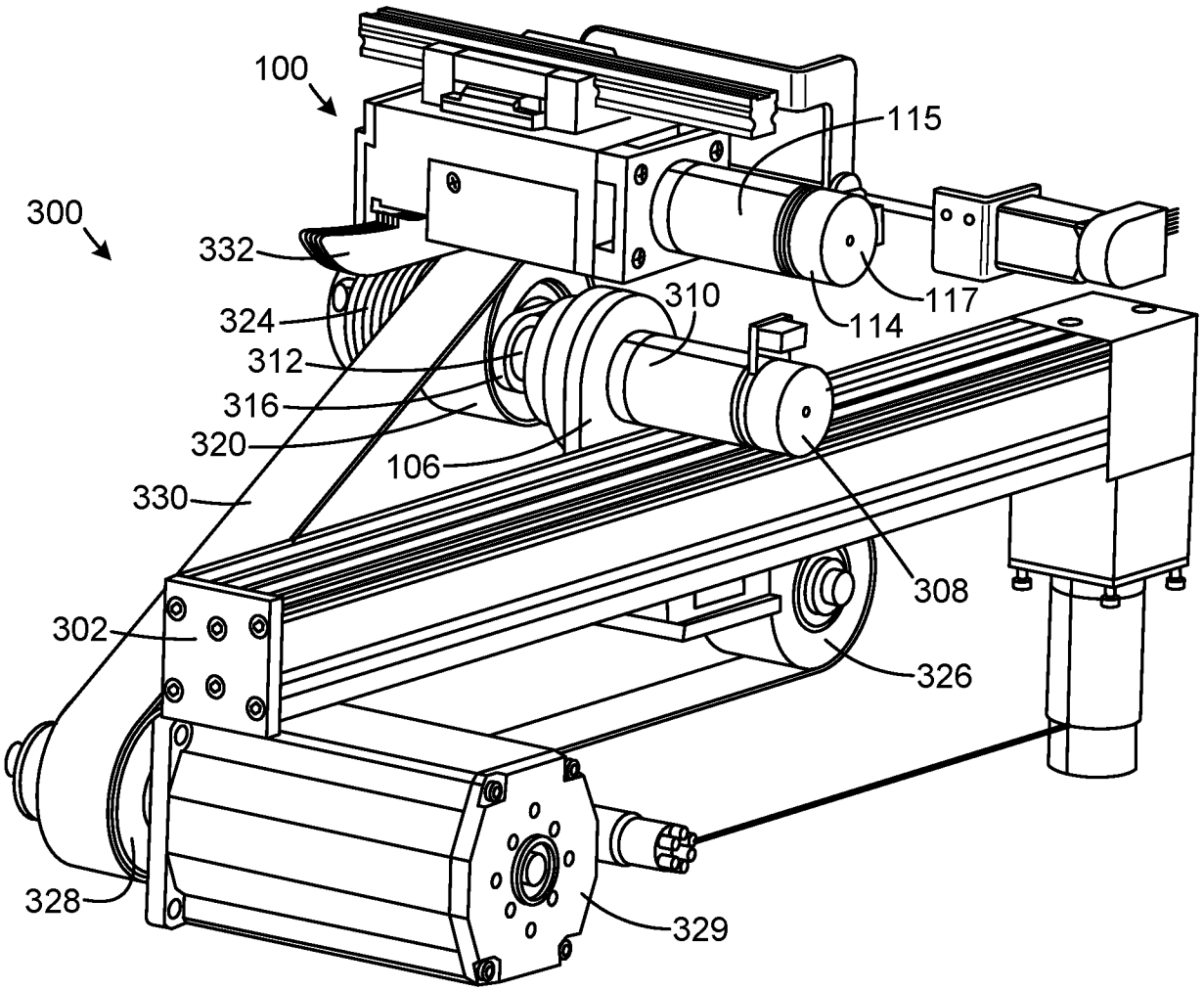
FIG. 8 is a perspective view of the blade holder of the present invention including the abrasive belt assembly shown in FIG. 7.

With reference to FIGS. 7-8, an elongate linear control unit assembly 300 includes an elongate control unit 302 that has a slide or rails 304 along which a contact wheel assembly 306 may slide. More particularly, underneath the linear control unit, the assembly 300 with a contact wheel is connected to the slide. The assembly 300 is fully computerized so that a computer calculated and controls the movement of the various components of assembly 300 via computer programs. The assembly is very dynamic and can be used to profile and sharpen virtually any profile of the blades because the abrasive belt and the rollers are very adaptive and can follow and digitally register/record the profiles of the blades so there is no need to use physical templates.

The assembly 300 and computer can thus be used to create profiling/grinding and sharpening programs based on the sensed or registered profiles by the contact wheel. It is to be understood that the present invention can also create virtually any profile because it is computer driven that creates profiles based on software. In other words, the assembly 300 may also be used to create virtually any profile of the blades by selecting a suitable sharpening/grinding program. It is also possible to do test or reference runs so that the contact wheel may follow the contour or profile of the blades to be ground. In this way, the motor 308 acts as a spring when the contact wheel follows the profile of the blade assembly. This "sensing" step by the contact wheel is done without rotating the abrasive belt. In this way, the computer can determine the location and profile of the blades by creating a reference program so that the computer can calculate how to best grind the blades to create the desired profile. The computer may be used to set different grinding pressures depending upon the number of blades that are to be ground or sharpened. The computer may also adjust the speed of the sideways movement of the contact wheel depending upon how many blades are to be profiled/ground and the effect of the motor driving the abrasive belt. The motor effect and the sideways movement of the contact wheel are thus adjusted to one another to optimize the grinding along an optimized effect curve so that a constant grinding pressure can be used. When the maximum effect of the motor is required then the computer, preferably, lowers the speed of the sideways movement of the contact wheel as the linear control unit moves horizontally so that the most optimal grinding results are accomplished. Preferably, the blades are fixedly held by the blade holder. The contact wheel is thus the part that is moving sideways. The computer may also determine how worn the abrasive belt is and the particle size on the abrasive belt based on the performance of the belt as it is used for grinding the blades. Preferably, the abrasive belt is used for creating profiles of several blades that are held together by the blade holder. As described in detail below, the actual sharpening of a blade is, preferably, done by a disc that has the desired convex grinding shape and the blades are then sharpened one by one. The blade holder places or sideways shift the blade to be sharpened over the disc that has the selected shape radius. The software may be programmed with the position of each type of disc on the spindle so that blade holder can be shifted the correct distance to be placed over the desired disc.

An important feature of the assembly 300 is that it is designed to be able to control the position of the contact wheel 320 and the spindle 322 both horizontally and vertically, as explained below. The vertical and horizontal positions are determined by the angle of the positioning axle 312 that is turned by the motor 308. By using a gearbox 310 a high precision can be obtained as well as a high torque. Preferably, the contact wheel 320 is designed to follow a coordinate program to grind the bottom surface of the blades 332 that are held above the contact wheel 320. This results in a function that has virtually no limitations regarding how the skate profile of the blades can be ground. More particularly, the assembly 306 includes an electric motor 308 in operative engagement with a gearbox 310. A rotatable axle or rod 312 protrudes from the gearbox 310 through a bearing house 314. The axle 312 is rotatably attached to an end of an arm 316. The opposite end of the arm 316 is rotatably attached to an axle 318 that extends through a contact wheel 320 and an adjacent spindle 322 that has a plurality of grinding wheels 324 mounted thereon so that the contact wheel 320 rotates, the grinding wheels 324 rotate also. The construction of the spindle 322, discs 324 and the contact wheel 320 enables the discs 324 and contact wheel 320 to be moved both in a horizontal and vertical direction along a circular path because of the linear control unit 302 as well as a result of rotating the axle 312. The contact wheel 320 is thus eccentrically mounted relative to the axle 312 so that the second axle 318 is off-center or shifted away from the first axle 312. This makes it possible to move the contact wheel 320 relative to the first axle 312 so that the exact position of the wheel 320 may be adjusted in the horizontal and vertical directions along the circular path by rotating the axle 312 in a first or a second opposite direction. Preferably, the contact wheel 320 may rotate freely because of its built-in double bearing construction. The assembly 300 also has a first adjustable roller 326 and a second roller 328 so that the contact wheel 320, rollers 326, 328 may carry an abrasive belt 330. The roller 328 is in operative engagement with a motor 329 that drives the abrasive belt. Preferably, the roller 326 is adjustable to create a tension of the belt 330 and adjusts its position to horizontal and vertical movement of the contact wheel 320 in engagement with the non-elastic belt 330 when the contact wheel 320 follows the profile of the blades to be profiled or sharpened. The rotatable abrasive belt 330 may be used to grind the blades 332. The vertical movement of the contact wheel 320 and spindle 322 is fully controlled by the electric motor 308.

Figure 9:
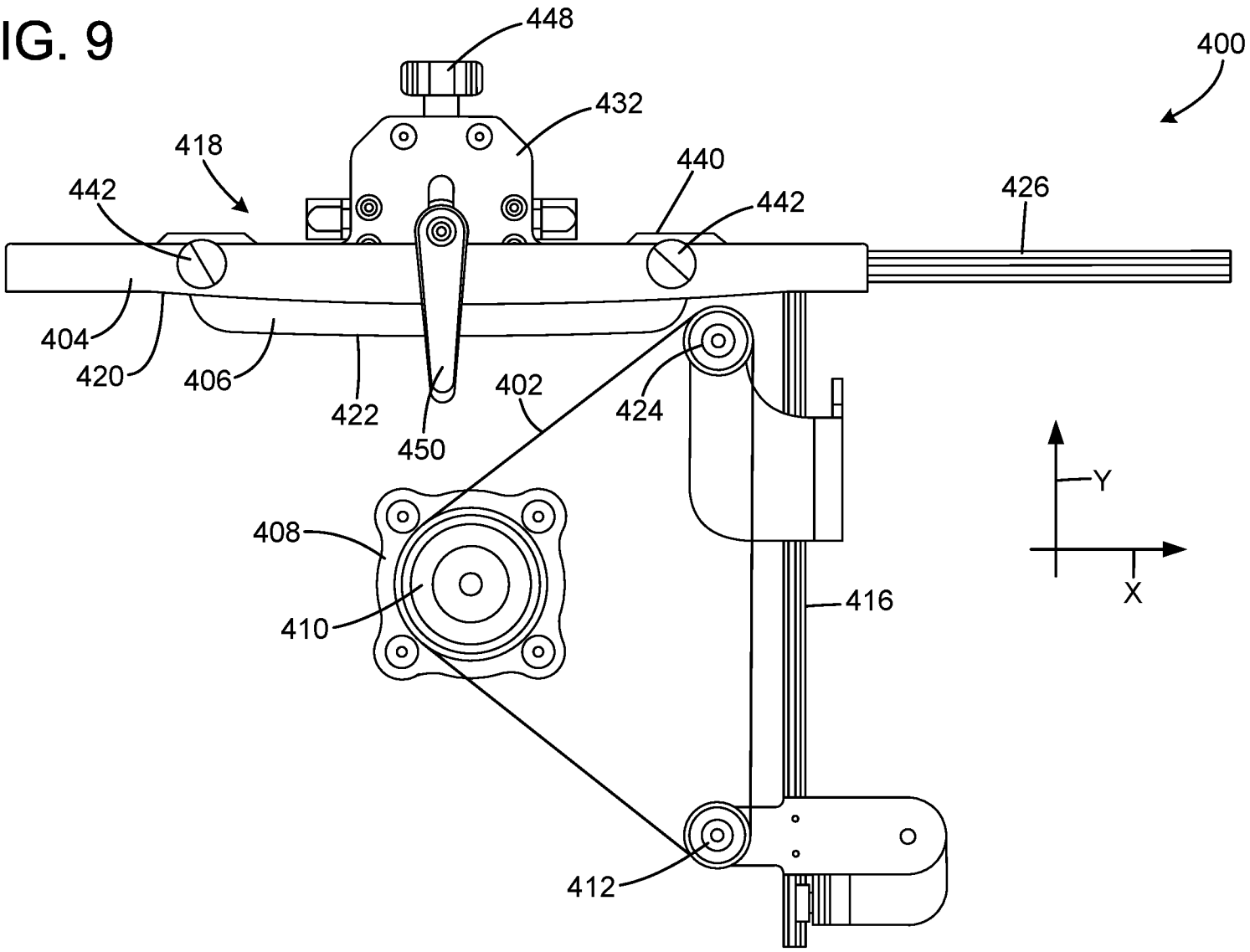
FIG. 9 is an elevational side view of a belt grinding profiling machine of the present invention.
Figure 10:
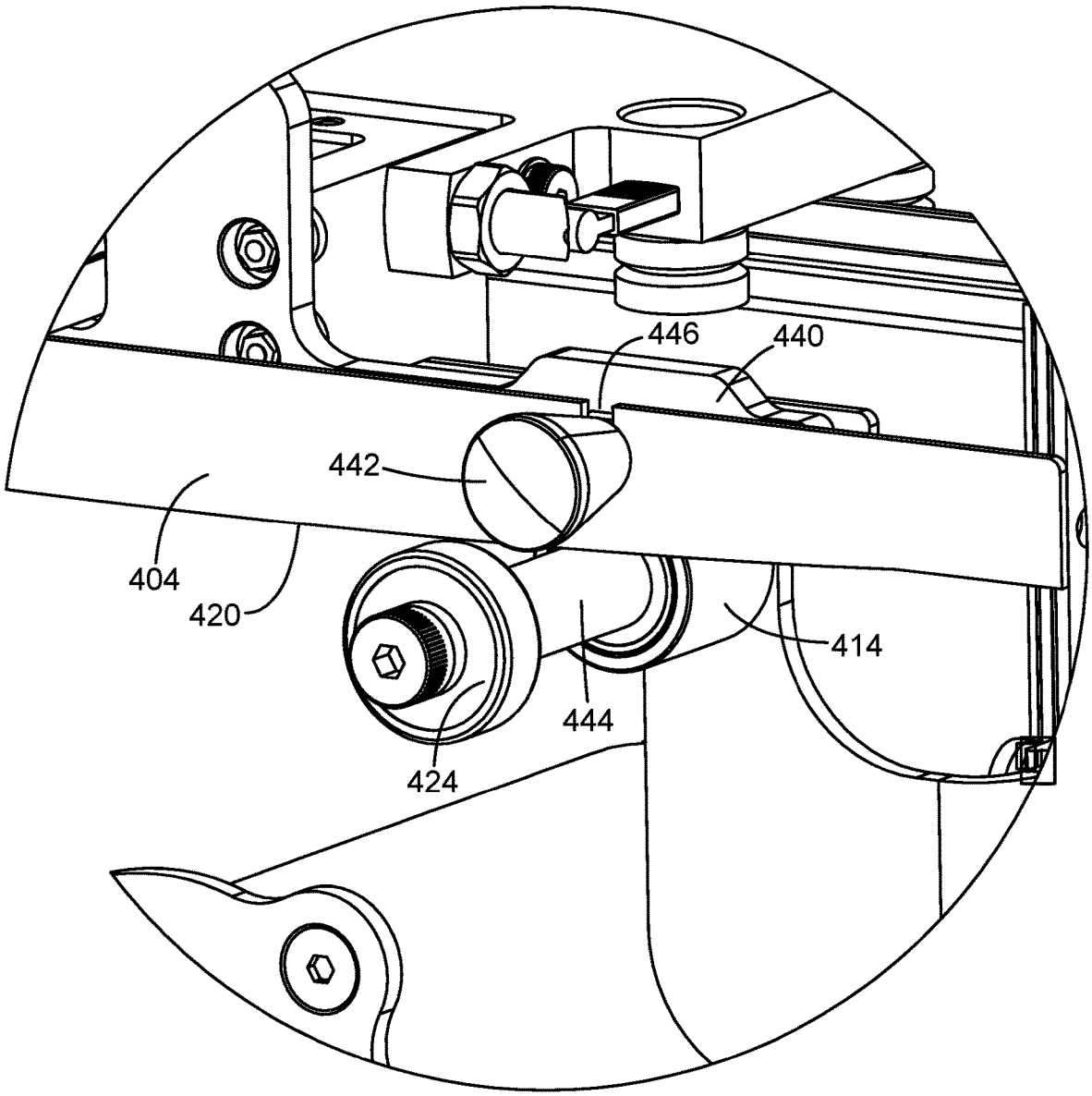
FIG. 10 a detailed perspective front view of the belt grinding profiling machine of the present invention shown in FIG. 9.
Figure 16:
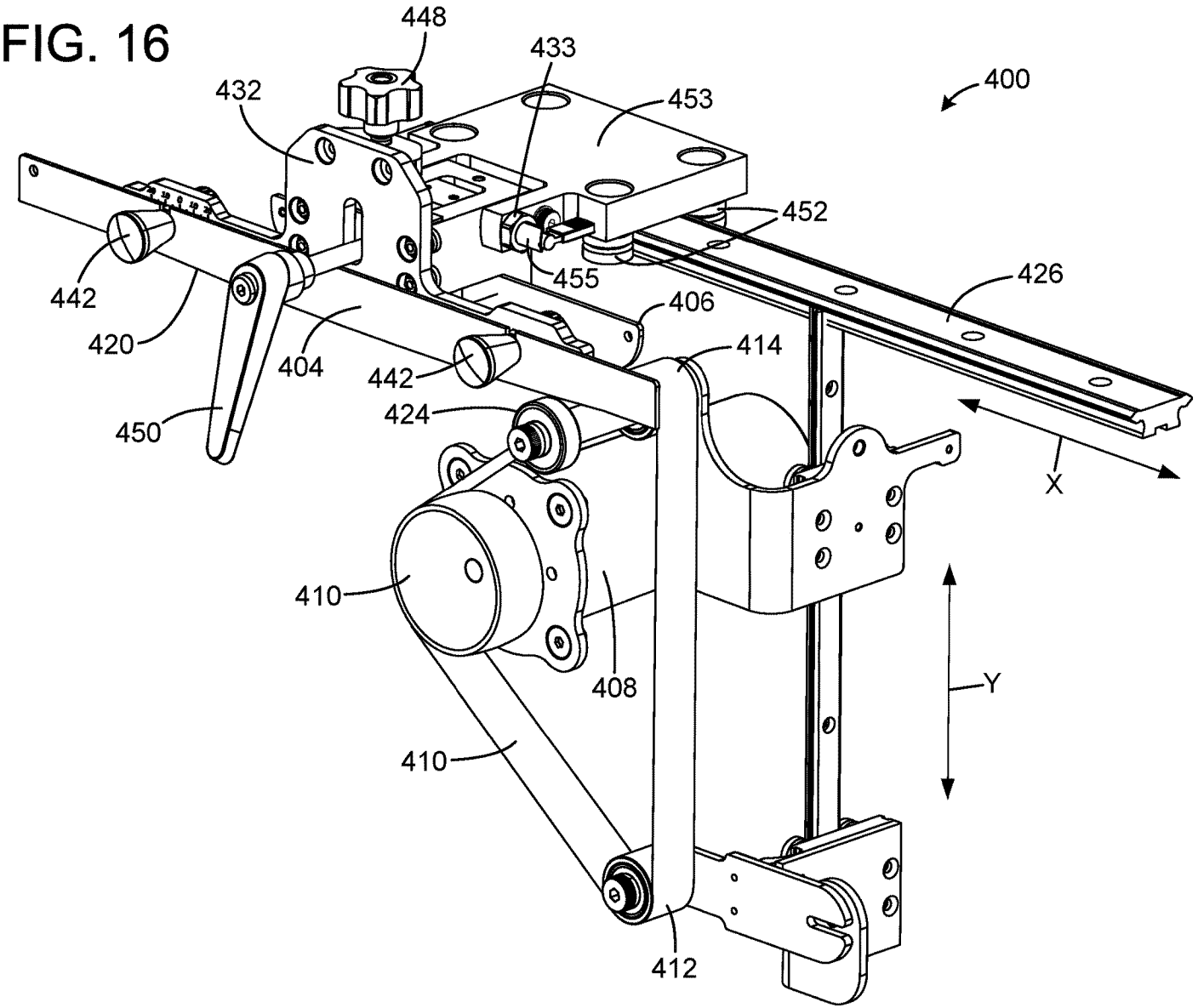
FIG. 16 is a perspective front side view of the machine of the present invention.
Figure 17:
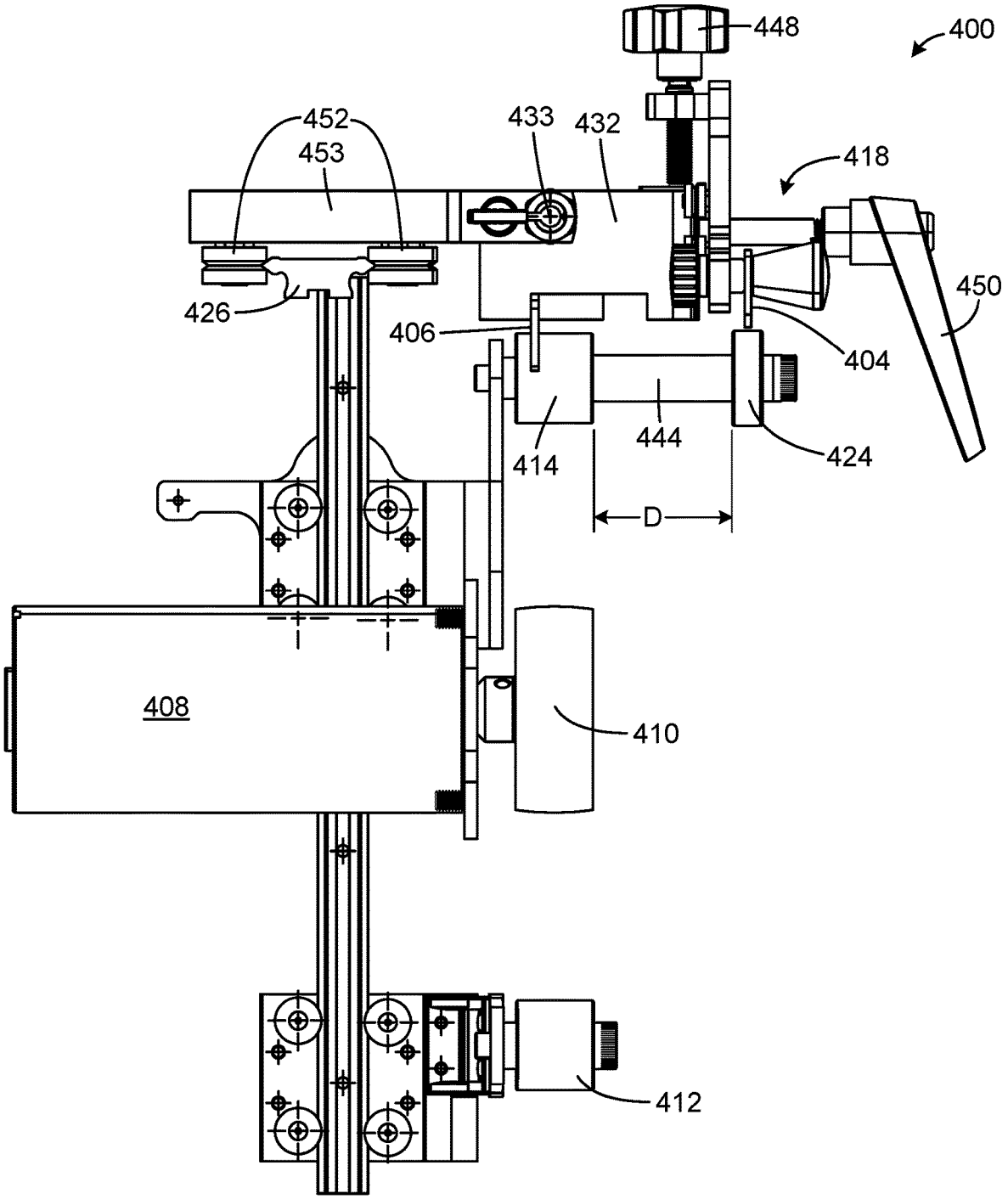
FIG. 17 is an elevational side view of the machine of the present invention.

With reference to FIGS. 9 and 16-17, an ice skate sharpener or manual belt grinding profiling machine 400 is shown that may be used to simultaneously profile 1-6 ice skate blades, stacked next to one another. Only one blade is shown in the figures. One of the most important features of the present invention is that it is possible to copy a profile of a template to ice skating blades even though the template profile is quite complicated. The underside profile of the template may have any suitable profile and this makes the present invention very versatile. Another important feature is the mechanism associated with the belt rollers provides adjustments of movement, belt tension and pressure in one system.

The machine 400 has a motor-driven belt 402 with three-wheel hubs 410, 412 and 414 that are in operative engagement with the rotatable belt 402. A motor 408 drives the driving wheel 410 to drive and rotate the belt 402 about hubs 412, 414. Preferably, the hubs or wheels 412, 414 are mounted on a Y-axis linear-guide rail 416, supported by hydraulic gas springs for grinding pressure, movement compensation and for maintaining a solid and consistent belt-pressure during the grinding procedure.

The machine 400 has a handle 450 that is used to lock, tighten and secure the blades 406 to be profiled or machined so that the blades 406 are firmly held in the vise 432 of the machine 400 during the grinding or profiling operation.

In order to mount the skate blades 406 into the machine 400, a tiltable vise 432 is mounted on a linear guide or rail 426 (X-axis). The vise 432 may be moved back and forth on the rail 426 in the x-direction. More particularly, the bottom of the vise 432 has a pair of rollers 452, mounted below a plate 453, that are held to the rail 426 and enable the vise 432 to slide along the rail 426. The vise 432 is tiltable relative to the plate 453 at hinges 455 to an open position to make it easier to set up and mount the blades 406. Once the blades are clamped in the vise 432, the vise 432 is tilted back to the closed position and locked in its horizontal grinding position.

The blade grinding and profiling copy system 418 is mounted in the front of the vise 432. The system 418 is adjustable in both the x- and y-directions for exact positioning of a guide roll 424 relative to an underside profile 420 of the template 404. The profile 420 has thus a profile shape or curvature as seen from the side. Preferably, the template 404 should be longer than the blades 406 so that it is only necessary for the guide roll 424 to follow a portion of the underside 420 of the template 404 in order to grind the entire underside 422 of the blade 406. During the set up, it is also determined which percentage (often between 50-75%) of the length of the template 404 is to be transferred or copied to the blade or blades 406. During the grinding operation of the blade 406, as long as the guide roll 424 does not roll on the underside profile 420 of the template 404, material is being ground of the underside 422 of the blade 406. When the guide roll 424 can roll on the profile 420 then no surface or material is ground off the blade or blades 406.

A key features of the present invention is thus the efficient profiling of the blade 406 because the shape of the underside profile 420 of the template 404 is copied to the underside 422 of the ice skate blade 406 by moving the vise 432 back and forth so that the rotatable belt 402, mounted on the rotatable rolls 410, 412, 414, grinds the underside 422 while the position of the grinding roll 414 and the grinding belt 402 are guided by guide roll 424 that, at the same time, is urged against to follow the profile of the underside profile 420 of the template 404. This is possible because the grinding roll 414 and the guide roll 424 are mounted to the same axle 444 but there is a distance (D) between the two rolls 414 and 424. The grinding roll 414 is generally wider than the guide roll 424 so that it can support a wider belt 402 to profile a plurality of blades 406 that are mounted next to one another. The idea of copying the profile of templates onto the blades means the profiles of the skate blades may be shaped into many different radiuses or shapes in a controlled fashion to suit each individual unique requirement.

When the blades 406 are mounted, the vise 432 is tilted into a forward position (best seen in FIG. 11) for easy access to mount the blades 406 therein. The vise 432 is then put back into the horizontal position and the lockable adjusting bolts 433 on each side of the vise 432 are tightened. The blades 406 are thus put into and centered in the vise 432 when the vise is in the open tilted position.

The template 404 is then mounted into the template holder 440 by tightening locking knobs 442. Preferably, a threaded elongate portion of the knobs 442 extend through cavities or grooves 446 in the template 404 and rest at the bottom of the grooves 446. The template may be adjusted into position by turning the top knob 448, mounted on top of the vise 432, to raise or lower the template 404 relative to the blades 406 and the guide roll 424 that is fixed in the y-direction on the rail 416. In this way the template 404 is raised or lowered relative to the blades 406 in order to minimize the amount of material that must be removed from the blades 406 in order to make the underside 422 obtain the same profile as the underside profile 420 of the template 404. It is also possible to adjust the template 404 sideways (x-direction) in a limit way.

The template holder 440 and vise 432 are then moved back and forth a few times in order to set the amount of surface to be removed from the blades 406. When the template 404 is moved back and forth (without having started the motor 408), the guide roll 424 indicates, by looking at the position of the grinding roll 414 relative to the underside 422, how much surface from the blades will be removed once the motor 408 is turned on to rotate the belt 402 and the guide roll 424 follows the underside 422 of the template 404 so that the belt 402 starts grinding off material from the underside 422 of the blade or blades 406.

Figure 11:
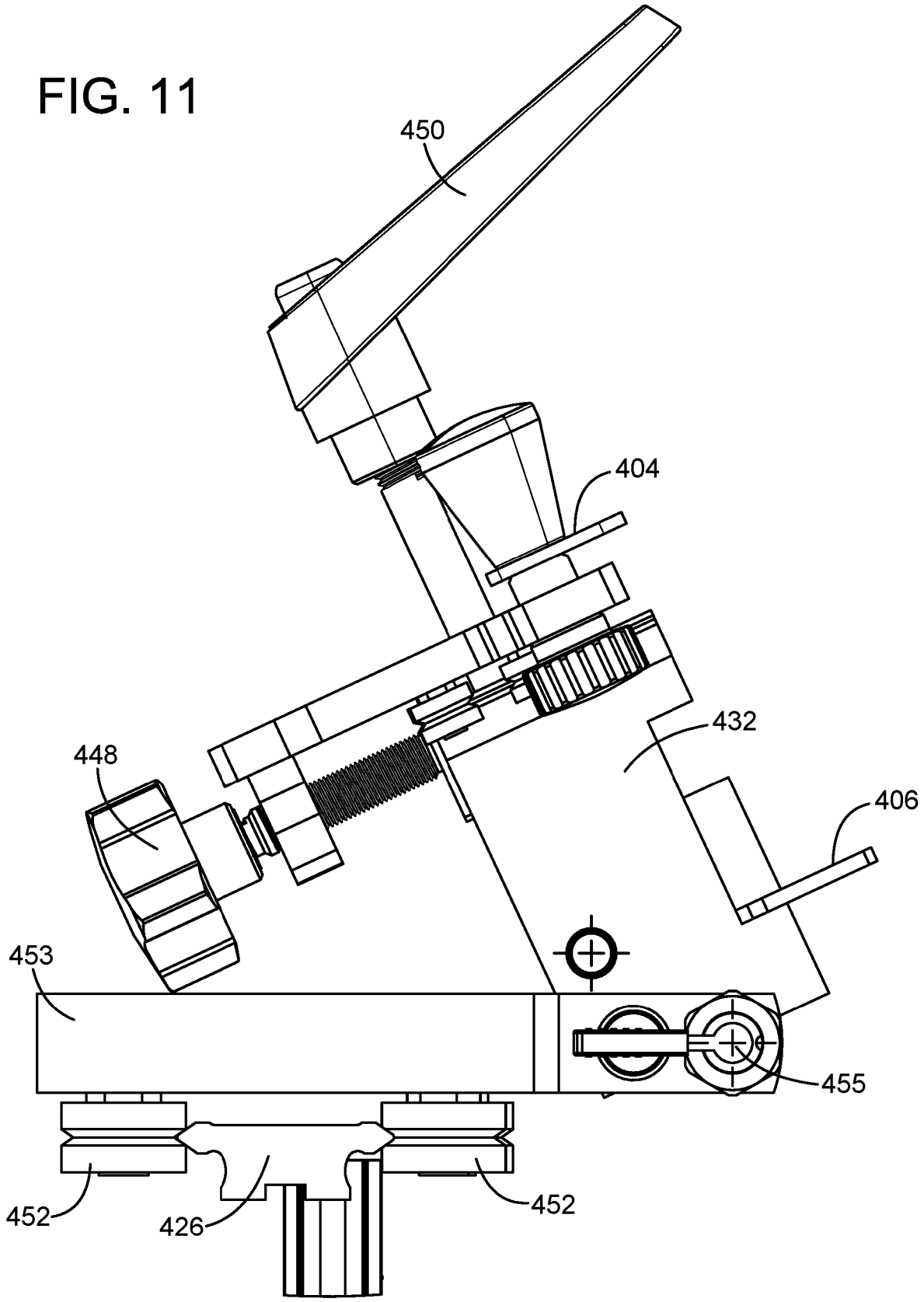
FIG. 11 is an elevational side of a tiltable vise in an open position of the present invention.

After the position of the template 404 is set, the grinding motor 408 is turned on to start the rotation of the grinding belt 402. The vise 432 is then moved back and forth on the rail 424 while placing the operator places his/her hand on the clamping handle 450. The back and forth movement of the vise 432 is repeated until grinding procedure is finished i.e. when no more surface is removed from the underside 422 of the blades 406 even though the vise 432 is moved back and forth while the guide roll rolls against the underside 420 of the template 404. The profile of the blade 406 is done when the guide roll can be rolled against the entire length of the template 404 without removing any additional surface or material from the blade 406. The grinding motor 408 is then stopped. The vise 432 is unlocked with the lockable adjusting bolts 433. The vise 432 is then tilted upwardly (as shown in FIG. 11), the grinding result on the blades is checked before removing the skate blades 406 from the vise 432. In order to make a complete finish of the underside profile 420 of the blades 406, a final sweep against the grinding belt 402 is often carried out without using the template. This blending step is to even out the finish of the profiled area or underside profile 422 of the blade 420.

Figure 12:
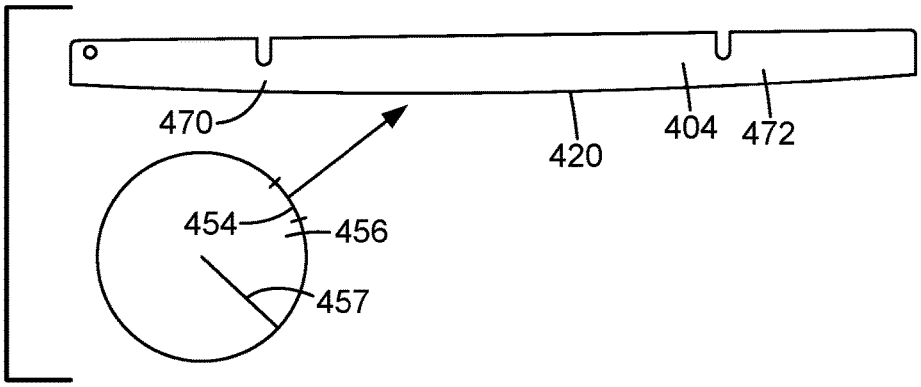
FIG. 12 is an elevational side view of a first embodiment of a template of the present invention.

With reference to FIG. 12, the template 404 has a front portion 470 and a back portion 472. This means the profile of the front portion 470 determines the profile of the front portion of the blade 406 and the back portion determines the profile of the back portion of the blade 406. For example, the profile 420 may a profile that is equivalent to a portion of a periphery 454 of a circle 456. In other words, the circle 456 is applied to the template 404 then cut to fit the bottom part of the template 404 so that the profile 420 is the same as the periphery 454 of the circle 456. The radius 457 of circle 456 may be very large such as 4 meter or any other suitable radius. The length of the template 404 may be about 450 millimeters or any other suitable length.

Figure 13:
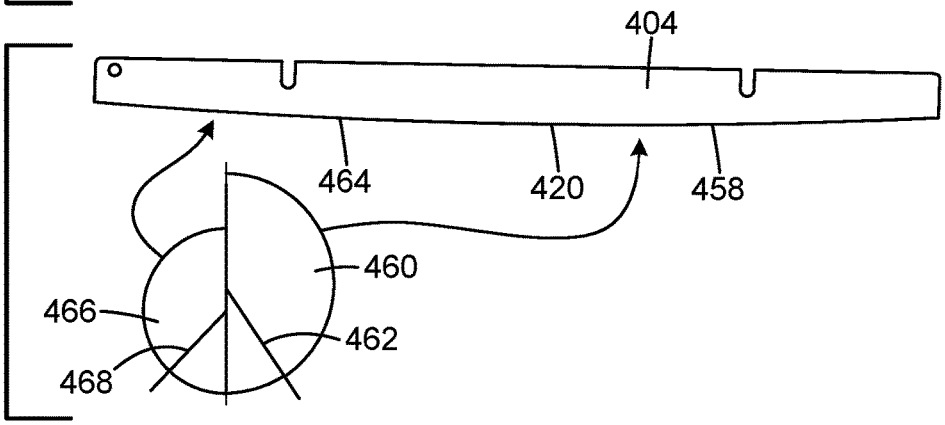
FIG. 13 is an elevational side view of a second embodiment of a template of the present invention.

The underside profile 420 may also be a combination of profiles so that it is a combination of more than one profile. FIG. 13 shows a template 404 that has a dual radius profile as the underside profile 420. This means a right-side half 458 of the profile 420 has a profile that is equivalent to the periphery of a section of a circle 460 with a radius 462 while the left-side half 464 of the profile 420 has a profile that is equivalent to the periphery of a section of a smaller circle 466 that has a radius 468 that is smaller than the radius 462.

Figure 14:
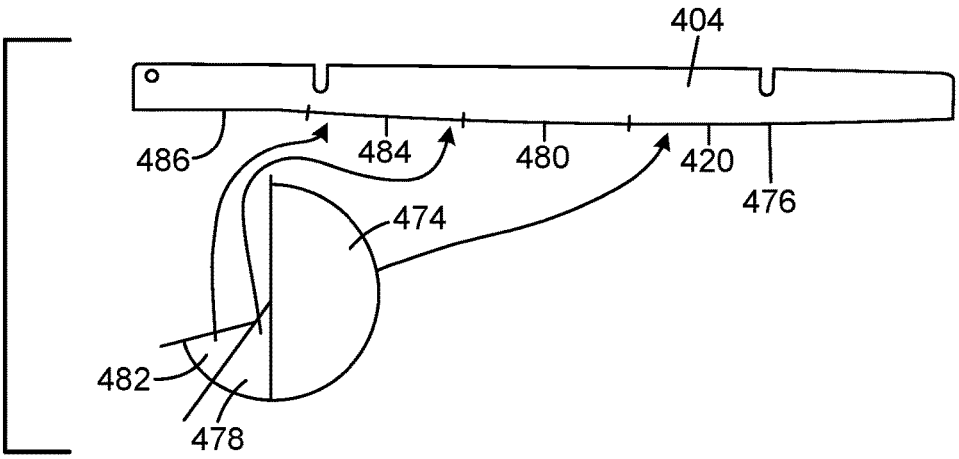
FIG. 14 is an elevational side view of a third embodiment of a template of the present invention.

FIG. 14 shows a template 404 wherein the underside profile 420 consists of a combination of three difference radii i.e. a section of a circle 474 that has a periphery that corresponds to the curvature or profile in section 476, a section of a slightly smaller circle 478 that has a periphery that corresponds to the curvature in section 480 and a section of a smallest circle 482 that has a periphery that corresponds to the curvature in section 484. Preferably, the very front part 486 of the template 404 is straight and has no curvature. The transition between the various sections of different curvature is seamless. The radiuses may be pitched from the center point and make up for different percentage of the overall template.

Figure 15:
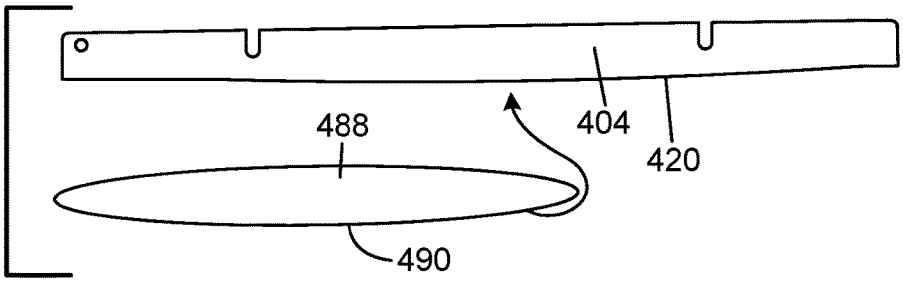
FIG. 15 is an elevational side view of a fourth embodiment of a template of the present invention.

FIG. 15 shows a template 404 wherein the curvature of the underside profile 420 is equivalent to the shape of an ellipse or conical section 488 so that the shape of the underside 490 of the ellipse 488 is the same as the shape of the profile 420. The relative position of the blade 406 to the template 404 is such that the blade 406 is centered to the template 404 but the position may be adjusted sideways when necessary.

While the present invention has been described in accordance with preferred compositions and embodiments, it is to be understood that certain substitutions and alterations may be made thereto without departing from the spirit and scope of the following claims.

We claim:

1. An ice skate profiling apparatus, the ice skate profiling apparatus comprising:

a movable blade holder configured for holding one or more ice skate blades elongate in a longitudinal direction of the apparatus;

a template holder coupled to the movable blade holder and spaced from the movable blade holder in a first transverse direction to the longitudinal direction of the apparatus, the template holder being configured to hold a template having a profiling surface comprising a profile to be copied onto at least a portion of an ice-contacting surface of the one or more ice skate blades;

a first hub and a second hub mounted on a common axle and spaced from each other in the first transverse direction, the first hub being configured to be movable in a second transverse direction to the longitudinal direction of the apparatus to contact and follow at least a portion of the profiling surface of the template held in the template holder, the second hub being configured to move in conjunction with the first hub; and a motor-driven abrasive belt connected to the movable blade holder, the abrasive belt being configured to be rotatable about the second hub and to move in conjunction with the second hub to contact the ice-contacting surface of the one or more ice skate blades to apply the profile of the template to the one or more ice skate blades;

wherein the blade holder is configured to be reciprocated along the longitudinal direction of the apparatus during a profiling operation of the one or more ice skate blades such that the one or more ice skate blades held therein translate relative to the rotating abrasive belt as the first hub follows the at least a portion of the profiling surface of the template, the rotating abrasive belt removing material from the at least a portion of an ice-contacting surface of the one or more ice skate blades to copy the profile of the template onto the at least a portion of an ice-contacting surface of the one or more ice skate blades.

2. The apparatus of claim 1, wherein the first hub is configured to follow the profiling surface of the template without rolling as the rotating abrasive belt removes material from the at least a portion of the ice-contacting surface of the one or more ice skate blades.

3. The apparatus of claim 2, wherein the first hub is configured to be rollable along the entire profiling surface of the template once the abrasive belt no longer removes material from the at least a portion of the ice-contacting surface of the one or more ice skate blades and the profile of the template has been copied onto the at least a portion of the one or more ice skate blades.

4. The apparatus of claim 1, wherein the apparatus comprises a motor configured to be activated to drive the abrasive belt and configured to be deactivated so as not to drive the abrasive belt.

5. The apparatus of claim 4, wherein: during a preparation operation preceding the profiling operation in which the motor is deactivated, the abrasive belt does not remove material from the at least a portion of the ice-contacting surface of the one or more ice skate blades and the blade holder is reciprocated along the longitudinal direction of the apparatus, the first hub is configured to provide a visual indication of an amount of the material to be removed from the ice-contacting surface of the one or more ice skate blades during the profiling operation by (i) not rolling along the at least a portion of the ice-contacting surface of the one or more ice skate blades to denote that material will be removed from said portion during the profiling operation;

and (ii) rolling along a remaining portion of the ice-contacting surface of the one or more ice skate blades to denote that material will not be removed from said remaining portion during the profiling operation.

6. The apparatus of claim 1, wherein the apparatus comprises a guiding mechanism for restricting motion of the blade holder along the longitudinal direction of the apparatus as the blade holder is reciprocated.

7. The apparatus of claim 1, wherein the apparatus comprises a guiding mechanism for restricting motion of the first hub along the second transverse direction to the longitudinal direction of the apparatus as the first hub contacts and follows the profiling surface of the template.

8. The apparatus of claim 7, where the guiding mechanism is further configured for restricting motion of the second hub along the second transverse direction to the longitudinal direction of the apparatus as the second hub moves in conjunction with the first hub.

9. The apparatus of claim 1, wherein the template holder comprises a positioning mechanism for positioning the template in the template holder.

10. The apparatus of claim 9, wherein the positioning mechanism is configured to adjust a position of the template in the template holder in at least one of the longitudinal direction of the apparatus and the second transverse direction of the apparatus.

11. The apparatus of claim 9, wherein the position mechanism is configured to adjust a position of the template in the template holder in both the longitudinal direction of the apparatus and the second transverse direction of the apparatus.

12. The apparatus of claim 9, wherein the positioning mechanism is further configured to lock the position of the template in the template holder.

13. The apparatus of claim 9, where the positioning mechanism comprises one or more positioning elements each comprising a projection configured to extend through one or more recesses in the template.

14. The apparatus of claim 1, wherein the apparatus comprises an adjustment mechanism connected to the blade holder for adjusting a position of the first hub relative to the profiling surface of the template.

15. The apparatus of claim 1, wherein the apparatus comprises an adjustment mechanism connected to the blade holder for adjusting a position of the profiling surface of the template relative to the ice-contacting surface of the one or more ice skate blades.

16. The apparatus of claim 1, wherein the blade holder is pivotable about the longitudinal direction of the apparatus between a first position for loading the one or more ice skate blades in the blade holder or unloading the one or more ice skate blades from the blade holder and a second position for profiling the one or more ice skate blades.

17. The apparatus of claim 16, wherein the blade holder further comprises a locking mechanism for locking the blade holder in the second position.

18. The apparatus of claim 1, wherein the blade holder further comprises a clamping mechanism configured to clamp the one or more ice skate blades in the blade holder.

* * * * *